United States Patent [19]

Villwock et al.

[11] 4,157,778

[45] Jun. 12, 1979

[54] BINDING SYSTEM

[75] Inventors: George F. Villwock, Chicago; Conrad R. Medina, Skokie, both of Ill.

[73] Assignee: Swingline, Inc., Long Island City, N.Y.

[21] Appl. No.: 839,357

[22] Filed: Oct. 4, 1977

[51] Int. Cl.[2] ..... B27F 7/22

[52] U.S. Cl. ..... 227/8; 227/30; 227/78; 227/127

[58] Field of Search ..... 227/4, 7, 30, 78, 100, 227/122, 127, 8

[56] References Cited

U.S. PATENT DOCUMENTS

| | | | |
|---|---|---|---|
| 2,947,033 | 8/1960 | Ericsson | 227/123 |
| 3,248,033 | 4/1966 | De Francis et al. | 227/100 |
| 3,516,589 | 6/1970 | De Francis et al. | 227/7 |
| 3,537,633 | 11/1970 | Hoff et al. | 227/7 |

*Primary Examiner*—Roy Lake

*Assistant Examiner*—Paul A. Bell

*Attorney, Agent, or Firm*—Pennie & Edmonds

[57] ABSTRACT

A binding system is disclosed for binding volumes comprising a cabinet having a trough herein for the receipt of an edge of a stack of sheets with power compressor means on one side of the trough for compressing the stack of sheets and power operated stapling means on the opposite side of the trough for driving staples through the major plane of said sheets adjacent said one edge while under compression. The cabinet also includes a second power operated stapler for binding smaller or thinner stacks of sheets to produce thinner volumes. An interlock provides that only one of the two power operated staplers may be used at a time. Provision is made for loading the larger of said power staplers through the top of the cabinet and a safety mechanism is provided to insure against ejection of staples from the magazine upward through the loading entryway.

5 Claims, 13 Drawing Figures

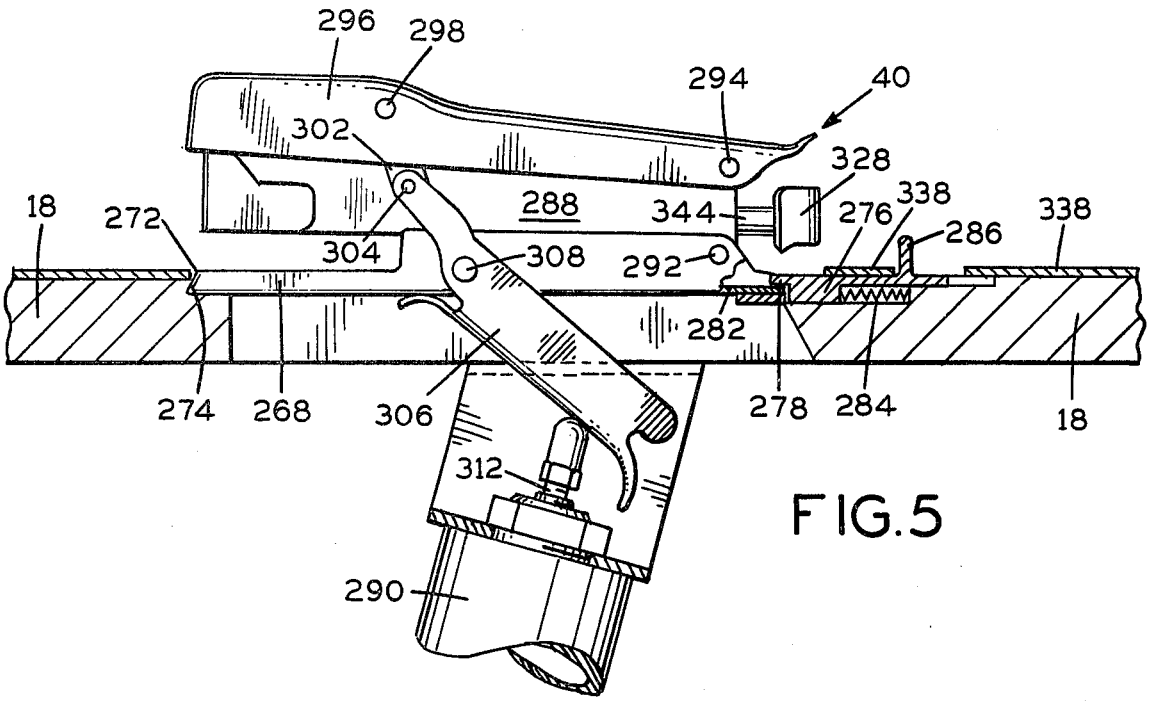
FIG.5
FIG.6
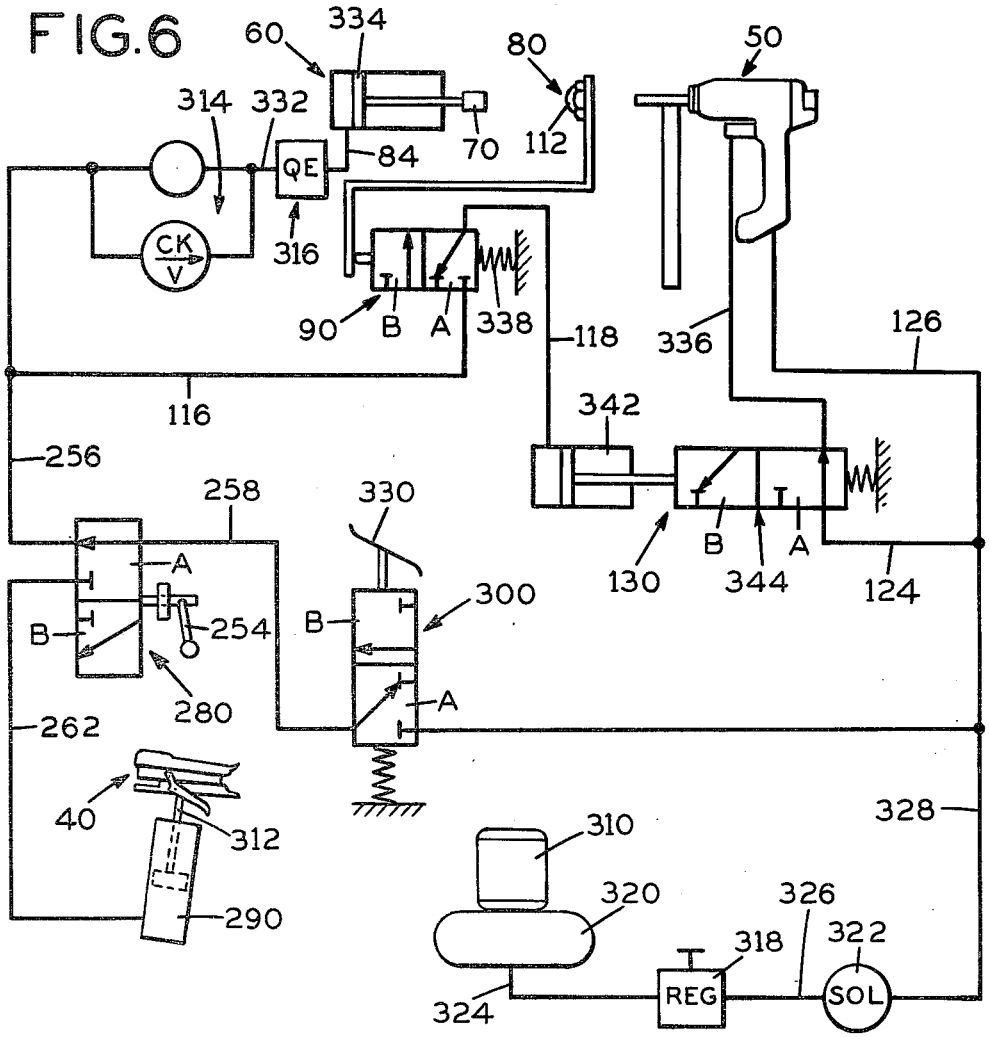

FIG.12
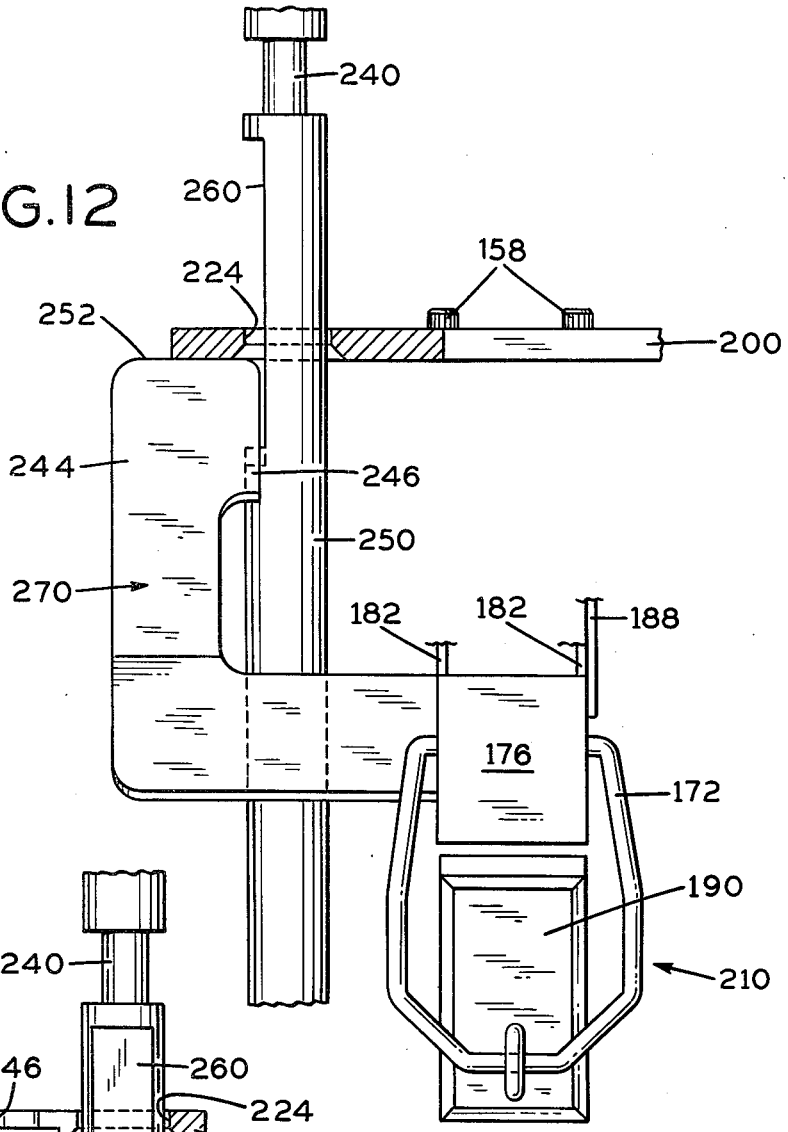
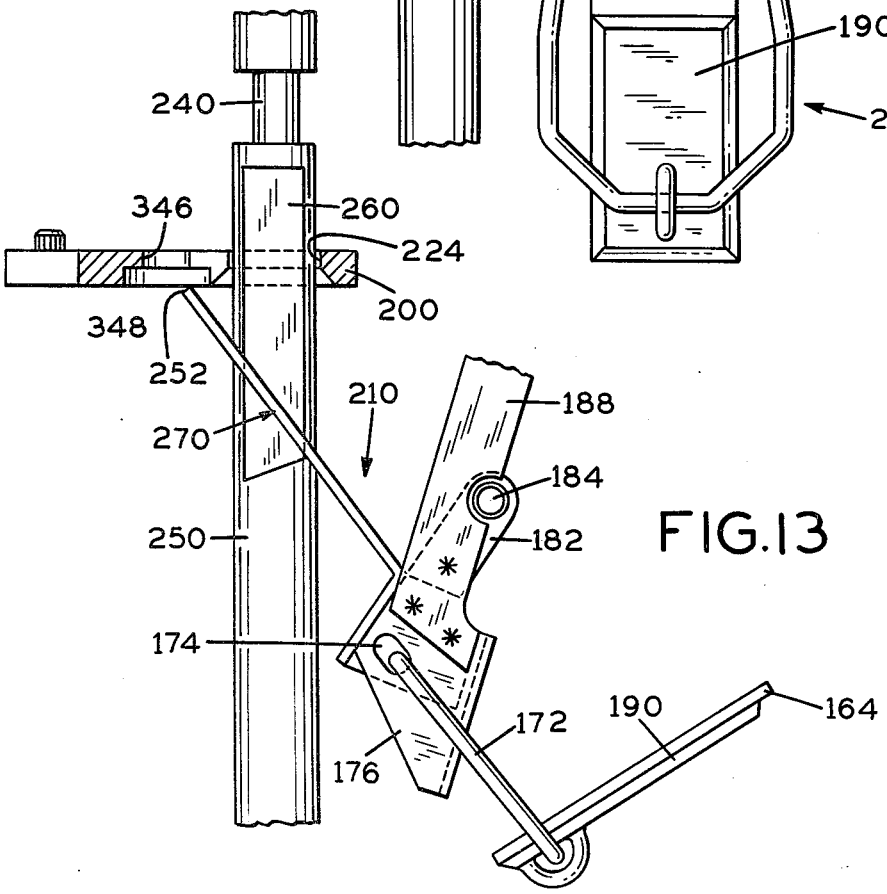
FIG.13

BINDING SYSTEM

BACKGROUND OF THE INVENTION

Present systems for binding thick volumes up to 2" in thickness or more include hot melt glues, adhesives, plastic post binders, prong fasteners and others. Each of such systems has advantages and disadvantages unique to itself but all reguire considerable time in aligning the sheets, applying the glues or adhesives, punching holes, aligning the same for fasteners or posts, and the like. This is particularly so of those systems designed for use in offices in which the production of such volumes is only incidental to the business and not its primary undertaking. There is, therefore, a need for a quick, neat, system for producing bound volumes requiring a minimum amount of time and a minimum amount of expertise, preferably, only that to be found in any office.

BRIEF DESCRIPTION OF THE INVENTION

The present invention is directed to a binding system which is greatly simplified and can produce volumes up to about 2" thick or thicker which requires an absolute minimum of expertise and a minimum of time since it eliminates the need for punching and drilling holes in the sheets, making alignment of the sheets, passing fasteners or posts through the openings, or experience with the use of hot melt glues or adhesives. In the present invention, a cabinet is provided with a top in which is located a trough for receipt of one edge of a stack of sheets to be bound. Located below the top and laterally of the trough to one side is a power operated compressing mechanism and on the opposite side of the trough facing the compressing mechanism and also beneath the top is a power operated stapling gun capable of driving staples through the thickness of the stack to produce a volume. A second, smaller, power operated stapler is provided on top of the cabinet for binding smaller volumes. Preferably, the top of the cabinet to one side of the trough is slidable to cover and uncover the trough for use. In this way the cabinet may be used for binding thick volumes when the top is open and thinner volumes when the top is closed. An interlock is provided so that only one of the two power operated staplers may be used at one time. When the top is closed the top of the cabinet may also be used for any purpose associated with a cabinet or tabletop. While the presently preferred operating power is pneumatic for both the compressor and the staple gun, it will be appreciated that electrical stapling guns, electrical sheet stack compressors, and the like may equally well be utilized. Since no hot melt glues or adhesives are used and since the fasteners are applied by machine the operation is extremely neat, quick, and easy.

BRIEF DESCRIPTION OF THE DRAWINGS

The invention will be readily understood by those skilled in the art by the following specification and drawings in which:

FIG. 5 is an enlarged view taken along the line 5—5 of FIG. 2;

FIG. 6 is a schematic showing of the pneumatic circuit used in the invention;

FIG. 12 is a view generally like FIGS. 8, 9 and 10 taken after accidental release of the pusher rod while reloading; and FIG. 13 is a view taken in the direction of the arrow 13 in FIG. 12.

DETAILED DESCRIPTION OF THE INVENTION

Figure 1:
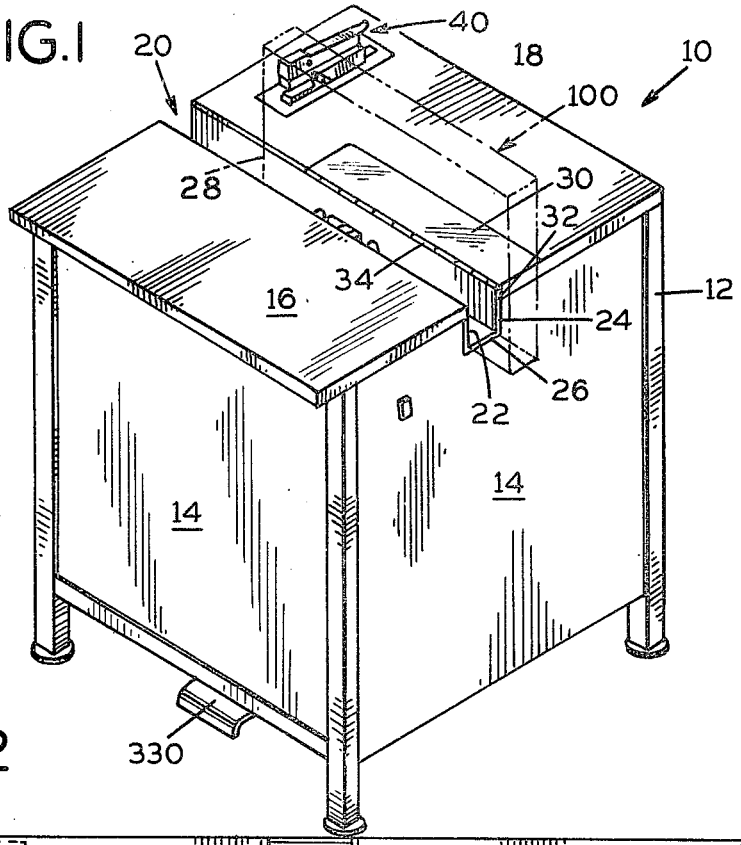
FIG. 1 is a top perspective view of the cabinets incorporating this invention showing a stack of sheets in position to be bound in phantom lines.
Figure 2:
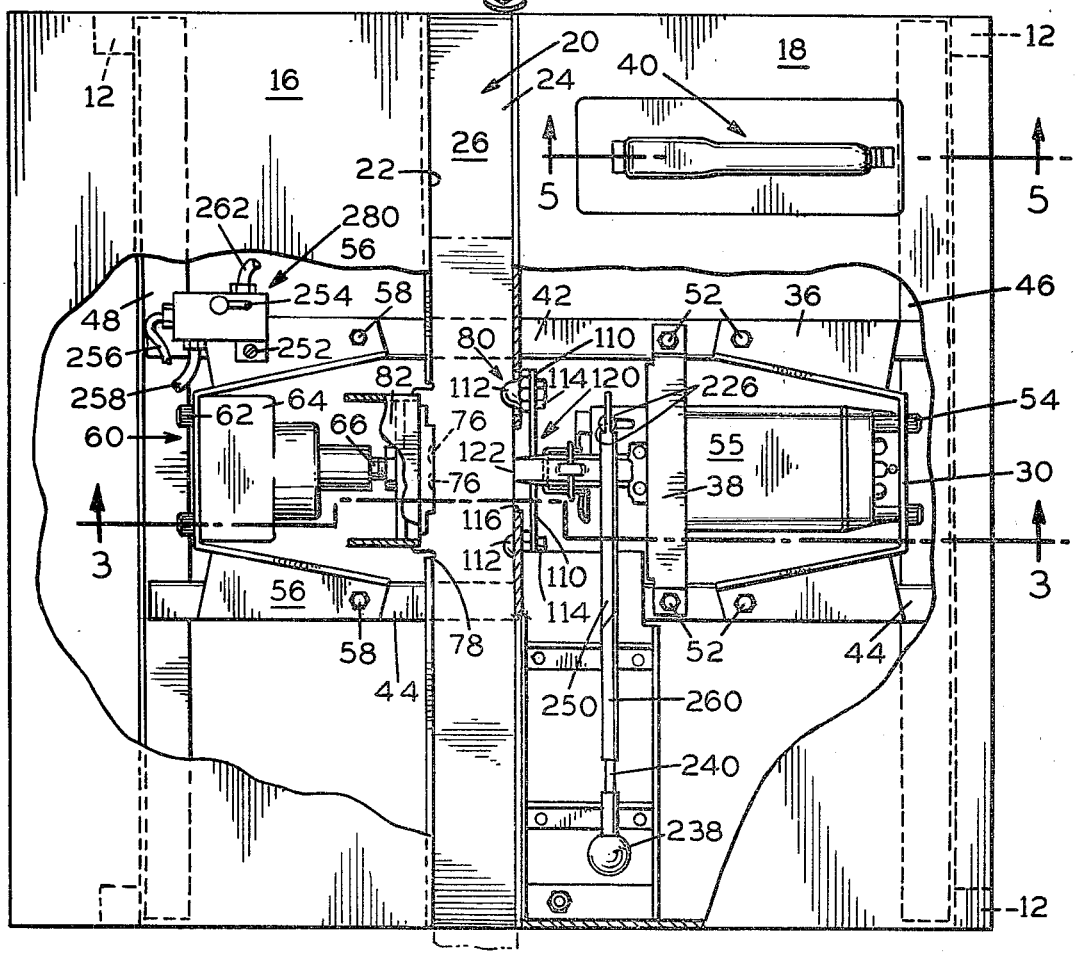
FIG. 2 is an enlarged top plan view of the cabinet of FIG. 1 with a portion of the top broken away to show the operating mechanism below.
Figure 3:
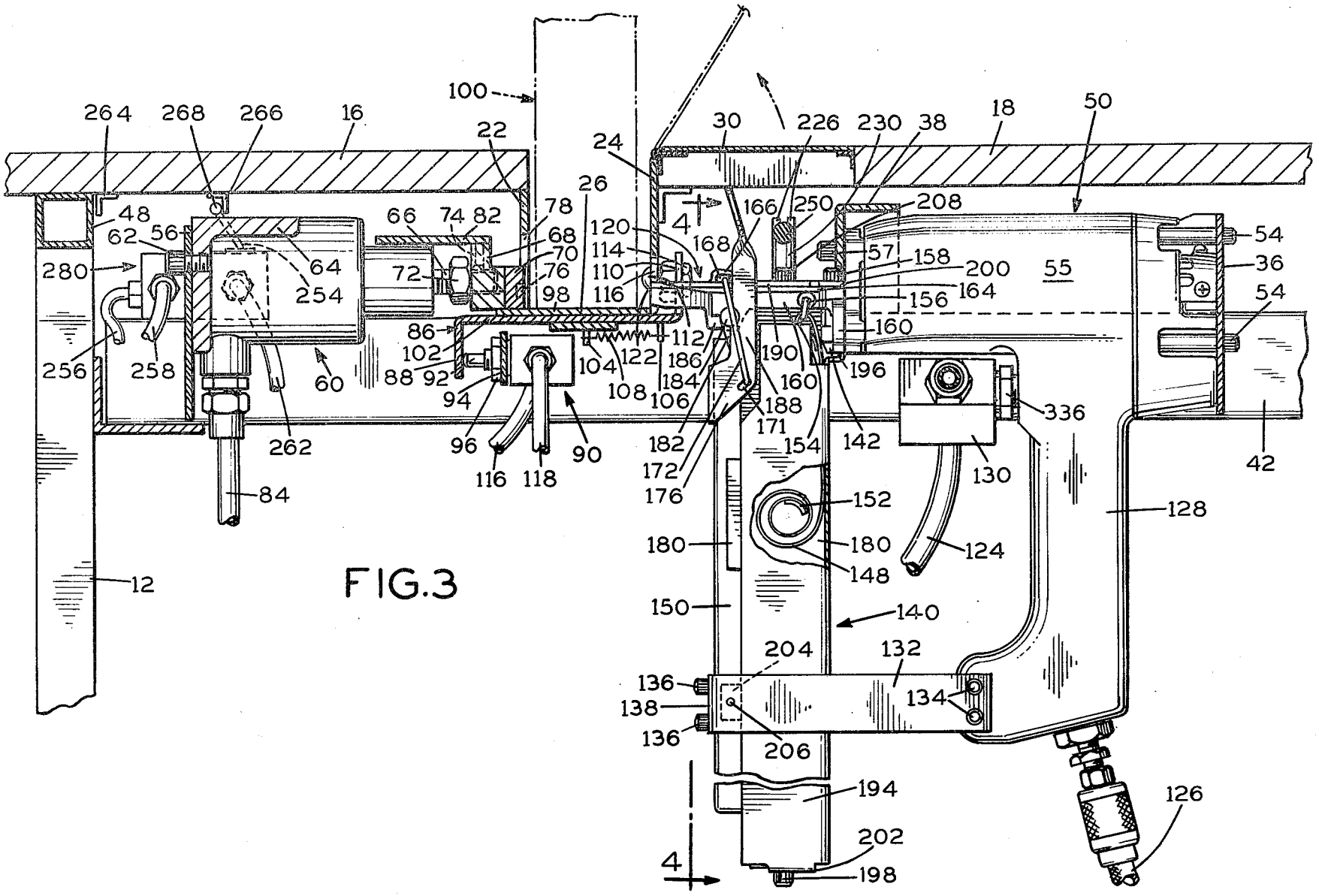
FIG. 3 is a further enlarged view taken along the line 3—3 of FIG. 2.

As shown in FIG. 1 the binding system is enclosed in a cabinet 10. The cabinet 10 includes a suitable frame, preferably of steel, not all of which is shown, but which includes four legs 12. Supported from the legs 12 are side and end panels 14 which enclose therewithin the operating mechanism of the system. The frame also supports a top comprised of two sections 16 and 18. As shown, there is a trough 20 extending downwardly into the cabinet 10 between the facing edges of the top sections 16 and 18. The trough 20 generally includes vertical side walls 22, 24 and a horizontal bottom 26 extending therebetween. The bottom is, preferably, not integral with the sides 22, 24 but is secured to them. The top section 16 is, prefrably, slidably mounted by any suitable mechanism, not shown, to move from the position shown in FIG. 1 to a position covering the trough 20. In the closed position of the top section 16 its edge 28 will abut the side of the wall 24 since as shown the side of the wall 24 covers the facing edge 32 of the top section 18. Also included in the top, and more particularly in the top section 18, is a door or cover 30 hinged at 34. The door 30 may be opened upwardly to provide access to the stapling gun 50 (see FIG. 2) for loading or unjamming the same all as more fully set forth below. Also mounted on the top section 18 is a smaller stapler 40 which is also power operated and may be utilized for binding thinner stacks of sheets into volumes. As shown in FIGS. 2 and 3 the top seciton 16 has been slid open (toward the left in FIGS. 2 and 3) by means of a sliding mechanism (not shown) of any suitable conventional type. The larger pneumatically powered stapling gun 50 is provided to one side of the trough 20 and facing it is a pneumatic piston and cylinder arrangement providing a compressor 60 on the opposite side of the trough 20. The staple gun 50 is mounted by brackets 36 and 38 to the braces 42, 44 which comprise part of the frame being secured at their opposite ends to the frame members 46, 48 which run parallel to each other between the legs 12. Suitable bolts 52 are provided to secure the brackets 36, 38 to the braces 42, 44 as clearly shown in FIG. 2. Screws 54 pass through the bracket 36 and into the casing 55 of the staple gun 50. Similar screws 57 (shown in FIG. 3 but not shown in FIG. 2 for purposes of clarity) pass through the bracket 38 and into the casing 55 of the staple gun 50. As such it will be seen that the staple gun is fixed with respect to the cabinet frame and with respect to the trough 20.

Opposite to the staple gun 50 the sheet stack compressor 60 is mounted by means of a bracket 56 to the same braces 42, 44 as the stale gun 50. Suitable bolts 58 secure the bracket 56 to the braces 42, 44. Screws 62 pass through the bracket 56 and into the housing 64 of the pneumatically operated compressor 60. At its end remote from the bracket 56 the compressor 60 has an outwardly extending piston rod 66 having threaded onto its end a ram 68 which is further secured by means of a lock nut 72 and a pin 74. On its outer face the ram 68 carries an anvil 70 having suitable drepressions 76 in the fact therof for bending over and clamping the ends of a staple in known manner. The ram 68 and anvil 70 rest upon the bottom 26 of the trough 20 in order to support the forward end of the pneumatic stack compressor 60. The ram 68 and anvil 70 extend through an opening 78 in the wall 22 of the trough 20. The plate 82 secured to the top surface of the ram 68 serves as a shroud or shield to prevent possible pinching of fingers, papers and the like between the ram 68 and the wall 22 of the trough 20 upon retraction of the ram by piston rod 66 after compression of a stack of sheets as hereinafter described. In this regard it should be noted that in FIGS. 2 and 3 the piston rod 66 is shown retracted with the face of the anvil 70 slightly retracted from the face of the trough wall 22 although a perfectly planar relationship with respect thereto is satisfactory. Within the casing 64 is a conventional pneumatic cylinder-piston arrangement (not shown) for providing reciprocating motion (left to right in FIG. 3) to the piston rod 66 upon pneumatic actuation thereof as hereinafter described. A conduit 84 extends from the pneumatic compressor 60 to the pneumatic circuit hereinafter described.

Also mounted adjacent to the trough 20 on the opposite side thereof from the stack compressor 60 is a trigger mechanism 80. The trigger mechanism 80 is best shown in FIG. 3 and comprises a generally Z-shaped sliding trigger member 86 extending below the lower surface of the bottom 26 of the trough 20 and having a depending leg 88 bearing against a plunger 92 of a straight leaf micro-valve 90. The straight leaf micro-valve is secured by means of a bracket 94 to the cross braces 42, 44 by means of a nut 96. Accordingly, the micro-valve 90 is fixed to the frame.

A frame plate 98 is secured between the frame members 42, 44 in any known manner (not shown) and is parallel to and spaced from the lower surface of bottom 26 of the trough 20 by an amount just to slidingly receive the center portion 102 of the Z-shaped trigger 86. A lug 104 depends from the plate 98 and a lug 106 depends from the center portion 102 of the trigger 86. A tension spring 108 extends between the lugs 104, 106 and is secured thereto in known manner. The micro-valve 90 includes an internal leaf spring (not shown) operating to extend the plunger 92 and move the trigger 86 to the left as viewed in FIG. 3. The spring 108 serves to urge the trigger 86 in the same direction.

Extending upwardly from the center section 102 of the trigger 86 are two flanges 110 spaced apart laterally of the center portion 102 (as shown in FIG. 2). These flanges 110 each support substantially hemispherically headed bolts 112 each of which is secured to its respective flange 110 by nut 114. These bolts 112 serve as bumper members against which a stack of sheets 100 are pressed by the ram and anvil 68, 70 of the compressor 60 upon actuation of the same as hereinafter described. The bumpers 112 extend into the trough 20 beyond the inner face of the trough wall 24 through an opening 116 therein. The end 122 of a nose piece 120 of the staple gun 50 also extends into, but not through, the opening 116 and is positioned between the bumpers 112. As shown in FIG. 3 the end 122 of the nose piece 120 is in the same plane as the interior surface of the trough wall 24 which faces the wall 22. However, the end 122 of the nose piece 120 may extend into the trough slightly. For proper insertion of staples the end 122 should not be recessed significantly with respect to the above-mentioned surface of the wall 24 which faces the wall 22.

The micro-valve 90, upon movement of the trigger 86 to the right as shown in FIG. 3 will have its plunger 92 depressed and actuate the firing of the staple gun 50 through the pneumatic circuit to which it is connected by means of conduits 116, 118.

As shown in FIG. 3 the staple gun 50 is a modified form of a known pneumatic stapling gun which is normally hand-held. As such the internal operating mechanism of the gun is not shown or described. The same includes a poppet valve which has air pressure supplied thereto on both sides thereof; however, since the area of the poppet valve exposed to compressed air on one side of the poppet valve is greater than the area exposed to the compressed air on the opposite side thereof the same is held normally in a first position. By bleeding air from the first face thereof while maintaining the compressed air on the opposite face thereof (the face with the smaller exposed area) the poppet valve may be moved to a second position. Upon movement of the poppet valve to the second position compressed air is admitted past the valve to a cylinder to drive a piston connected to a staple driver, all in known manner. In the present gun 50 the means for bleeding the air from the first face of the poppet valve comprises a pneumatically operated valve 130. Valve 130 is connected to internal air passages (not shown) within the gun through the air line 336 which is in the form of a short coupling. The pneumatically operated valve 130 when acted upon by the pneumatic circuit to do so will operate to bleed the air from the first side of the poppet valve as aforesaid. The pneumatically operated valve 130 is connected to the pneumatic circuit by a conduit 134. The conduit 126 connects the gun 50 to the pneumatic circuit all as hereinafter described.

The power operated staple gun 50 includes integrally with the casing 56 a handle portion 128 and a magazine portion 140 to which it is connected and braced by means of a brace 132 secured by means of screws 134 to the handle 128 at one end and by means of the screws 136 to the magazine bar 150 at its other end. The brace 132 is bent to provide a laterally extending leg 138 for this purpose (see FIG. 3). The magazine bar 150 is mounted at its upper end in a wear plate 160 in a known manner (not shown). The wear plate 160 is, in turn, secured by screws 142 passing through openings therein and into the housing 56.

The magazine bar 150 is generally rectangular in cross section and is dimensioned so that U-shaped staples 170 may be fitted over a shorter side thereof such that the legs of the staples slidingly embrace the longer sides thereof. A staple follower 180 also is dimensioned to fit slidingly over the magazine bar 150 and serves to urge the staples 170 upwardly along the bar 150 and into the staple raceway 144 (see FIG. 7) through a suitable U-shaped opening 146 through the lower wall 148 coiled of the raceway 144. The follower 180 is urged upwardly to follow and thus urge the staples 170 by means of a flat coil spring 148 coiled about a lateral curved projection 152 extending from and integral with the follower 180. At its upper end the flat spring 148 has a loop 154 through which passes one leg of a clip 156, the other leg of which is pivoted in an opening in the outer surface of the wear plate 160. The spring 148 tends to want to coil about the projection 152 thus urging the follower 180 upwardly and in turn urging the staples 170 upwardly into the opening 146 in the wear plate 160 and into the raceway 144.

Figures 4, 7:
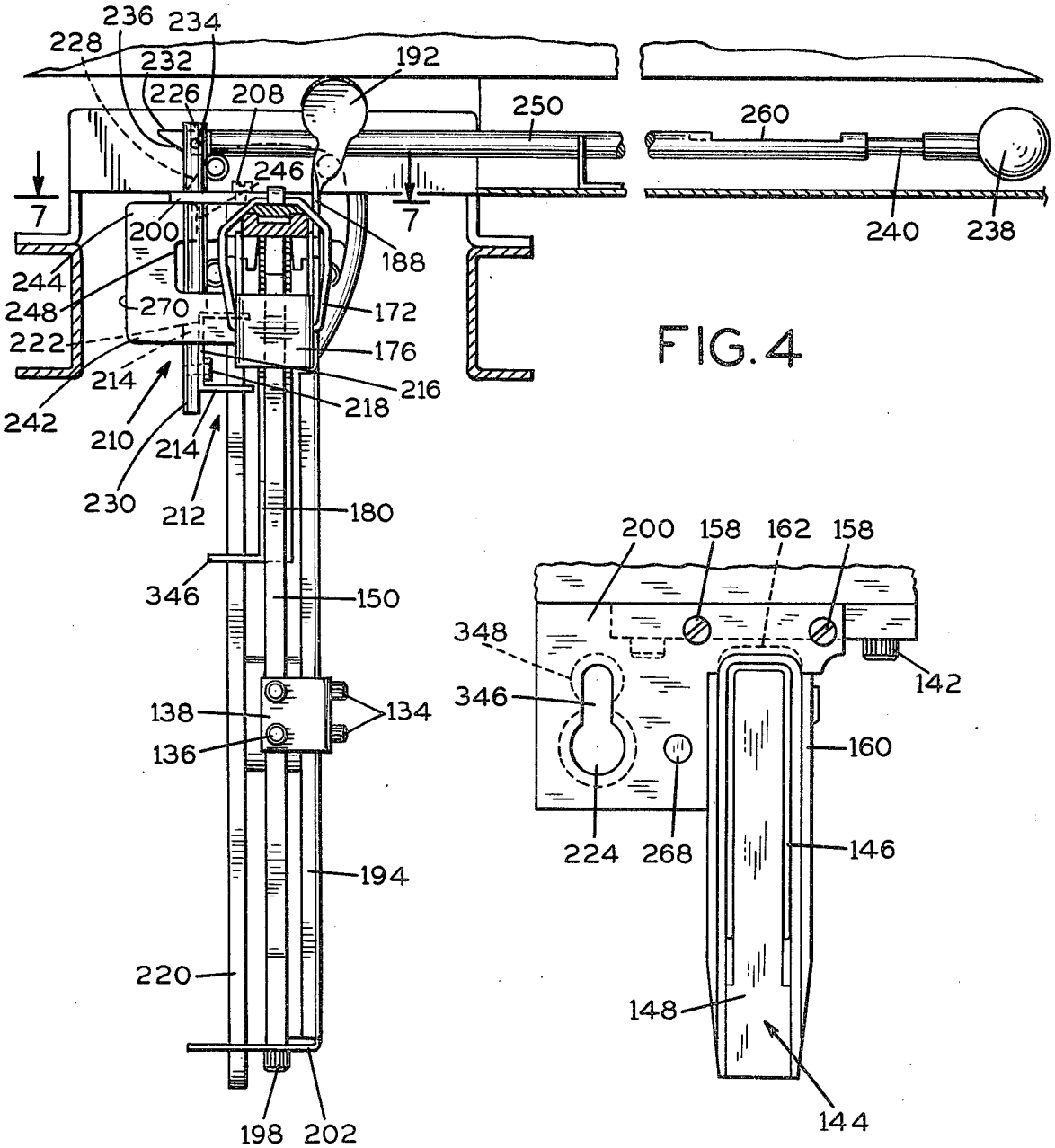
FIG. 4 is a still further slightly enlarged view taken along the line 4—4 of FIG. 3.
FIG. 7 is a view taken along the line 7—7 of FIG. 4 with some parts removed.

As shown in FIG. 7 the raceway 144 is open; however, in normal operation it is closed by means of an access plate 190. The access plate 190 and the wear plate 160 comprise the nose piece 120 and together define the raceway 144. A fixed guide plate 200 is secured by screws 158 to the wear plate 160. As best shown in FIG. 7 the guide plate 200 has on its underside a recessed portion 162. A flange 164 (see FIGS. 3 and 11) on the access plate 190 extends into this recess and against the facing surface of the wear plate 160 thus securing one end of the access plate 190. The access plate 190 also includes an eye 166 having a slot 168 through which a spring wire bail 172 extends. The ends of the bail are bent toward each other and set within slots 174 on either side of a U-shaped memeber 176 which is part of a latch assembly 210. The U-shaped member 176 has the bight 178 thereof bearing against one short side of the magazine bar 150 in the closed and operable position for the access plate 190 as shown in FIGS. 3 and 4. The sides of the U-shaped member 176 are spaced apart significantly wider than the width of the staples used in the gun in order that they may pass readily therebetween without touching the same. Welded to or integral with the section 176 is a pair of upwardly extending legs 182 pivoted at 184 to a downward extension 186 of the wear plate 160. The pivots 184 comprise pins extending through openings in the legs 182 and into openings on the opposite lateral edges of the rearward extension 186 thus permitting pivoting movement of the member 176 about the pivots 184. As shown in FIG. 3 the bail 172 lies to one side of the center of the pivots 184 and the tension therein holds the access plate 190 in place against the facing surface of the wear plate 160 with the flange 164 of the access plate 190 engaged in the rearward or downward recess 162 in the guide plate 200.

Figure 11:
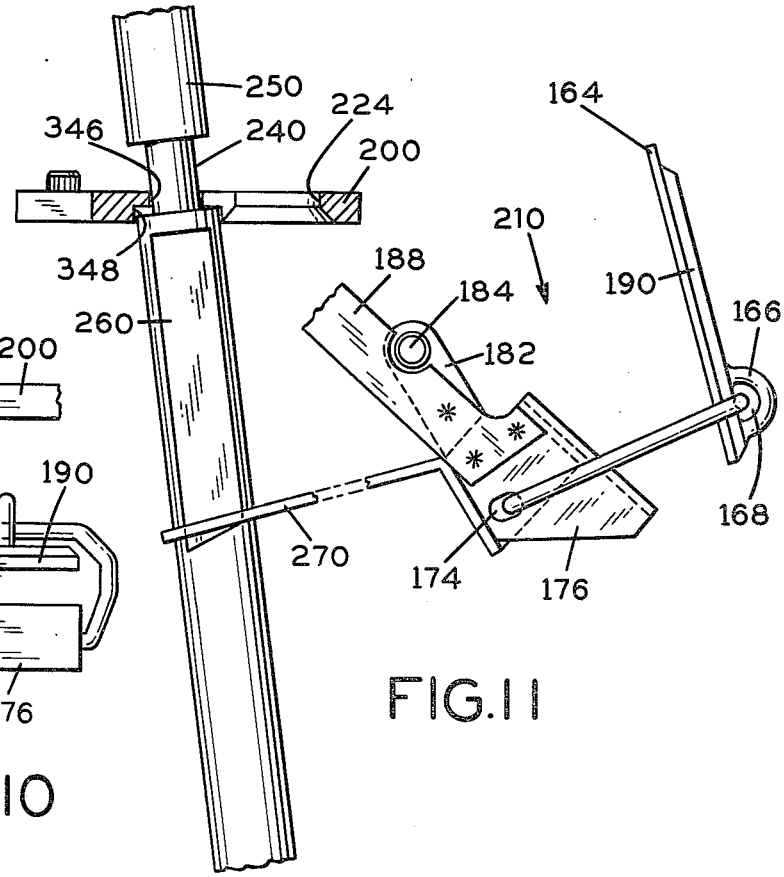
FIG. 11 is a view taken from the direction of the arrow 11 in FIG. 10.

An upward extension 188 of the U-shaped member 166 which may be integral therewith or separately formed and welded thereto has a terminal portion 192. The terminal portion 192 provides convenient means for manually opening the access plate 190. As described in more detail below thumb or finger pressure applied to the terminal portion 192 from left to right as shown in FIG. 3 will pivot the latch assembly about the pivots 184 at first stretching the bail 172 as it passes "over center". Further movement causes the bail 172 to lie to the left of the pivots 184 shown in FIG. 3 thus freeing the access plate 190 and providing access to the raceway 144 for insertion of staples or for the correction and removal of any jammed condition. This open condition is also shown in FIGS. 11 and 13.

A cover 194 is also provided for the magazine and extends along substantially its entire length. At its upper end the cover 194 has a narrow L-shaped extension 196 which fits into a slot in the wear plate 160. At its opposite end the cover 194 has a screw 198 passing through a suitable opening in a flange 202 extending at a right angle to the length of the cover 194. Screw 198 passes through the flange 202 and into a suitably tapped hole in the end of the magazine bar 150. For further securement the magazine cover 194 may have a laterally extending flange 204 secured to the brace 132 by any suitable means such as a rivet 206.

As shown in FIG. 4 the flange 202 of the magazine cover 194 extends well to the opposite side to the magazine bar 150 where it has a substantially square opening for receipt of a substantially square guide bar 220. The guide bar 220 fits snugly within the opening in the flange 202 at one end and at its other, upper end the guide bar 220 has a tapped hole for receipt of a screw 208 which passes through an opening in guide plate 200 and into said tapped hole in order to secure the upper end of guide bar 220.

The follower 180 has a lateral flange 346 with an opening therethrough. The guide bar passes loosely through the opening in the flange 346 of the staple follower 180 thus permitting the follower 180 to slide therealong as well as along the magazine bar 150. A C-shaped support bracket 212 has spaced, generally parallel, legs 214 each of which also has openings therethrough for the guide bar 220 in order to permit support bracket 212 to move slidingly along guide bar 220. The portion 116 of the bracket 212 is screwed by means of a screw 218 to a lower pusher rod 230. Lower pusher rod 230 has a relieved portion in the area bolted to the support bracket 212 thus providing a shoulder 222 which rests upon the upper of the two legs 214 of the bracket 216. Above the bracket 216 the lower pusher rod 230 has its full cylindrical diameter. The lower pusher rod 230 extends upwardly through an opening 224 in guide plate 200 (see FIG. 7). Above the guide plate 200 the end of the lower pusher rod 230 is bifurcated as shown at 226 in FIG. 2 to provide a slot therebetween. The bottom 228 of the slot between the bifurcated ends 226 is slanted as shown in FIG. 4. Placed between the bifurcated ends 226 of the lower pusher rod 230 is a reduced end 232 of an upper pusher rod 250. This reduced portion 232 is pivoted at 234 to the bifurcated ends 236 of the lower pusher rod 230 and fits therebetween snugly but pivotably. The end 232 has a slanted portion 236 which bears against the slanted floor 228 of the slot between the bifurcated ends 226 when the upper pusher member 250 is pivoted 90° counterclockwise from its position shown in FIG. 4 to the vertical position. The upper pusher rod 250 lies below the door 30 in the fixed section 18 of the top of the cabinet during normal operation and it is pivoted upwardly only for the purposes of correcting a jammed condition or loading staples into the magazine. On the end opposite to the pivot 234 the upper pusher rod 250 has a knob 238. A reduced diameter portion 240 is spaced a short distance from knob 238. Adjacent the reduced diameter portion 240 there is also provided a flat relieved portion 260 on one side of the upper pusher rod 250.

The latch mechanism 210 also includes an L-shaped cantilevered safety catch 270 formed integrally with or welded to the U-shaped portion 176 and extending to the left thereof as viewed in FIG. 4. The lower portion 242 of the safety catch 270 extends generally horizontally as viewed in FIG. 4 and has a generally upright portion 244 integral therewith. In the latched position of the latch 210 as shown in FIG. 4 the upright portion 244 of the L-shaped safety catch 270 extends somewhat away from the viewer as well as upwardly. On its end remote from the U-shaped member 176 the safety catch 270 has a laterally extending portion 246 which lies behind the lower pusher rod 230 in FIG. 4. The portion 242 lies in front of the pusher rod 230 as shown in FIG. 4. Stated another way, the upright portion 244 is provided with an elongated notch 248 in order that the lower pusher rod 230 may pass thereby.

As shown in FIGS. 2 and 3 a toggle valve 280 is provided. Toggle valve 280 is secured by one or more screws 252 to the bracket 56 as shown although it may be secured to any convenient portion of the frame such as bar 44. The toggle valve 280 has an upwardly extending toggle member 254 capable of being switched to either one of two positions by sliding the sliding section 16 of the top. The toggle valve 280 is connected to the pneumatic circuit by means of three conduits 256,285,262. As shown in FIG. 3 the movable table section 16 has two spaced depending stop members 264,266 positioned to engage the end 268 of the toggle 254. Operation of the toggle switch 280 serves to insure that only one or the other but not both of the power operated staplers 40 and 50 may be activated at any time. As shown, section 16 of the top has been slid open exposing the through 20 for use. The stop 266 has pivoted toggle 154 to the left as viewed in FIG. 5. As such the toggle valve 280 will permit only staple gun 50 to operate. When the slidable top action 16 is moved to close the trough 20 (to the right in FIG. 3) the end 268 of the toggle 254 will be engaged by stop 264 and pivoted to the right. Thus valve 280 will be switched to its other mode in which only the smaller power operated stapler 40 may be operated. As such, it will be seen that only one of the two power operated stapling mechanisms may be operated at any one time.

The small power operated staple gun 40 is shown in FIG. 5 as having a base 268 having a downwardly slanted forward end 272 engaged in a cooperating slanted notch 274 in the top section 18 of the cabinet. At its rearward end the stapler 40 is held in place by means of a sliding catch 276 which has a forwardly extending upper flange 278 engaged over the bottom 282 of the channel shaped base 168. The catch 276 is urged into its retaining position shown in FIG. 5 by means of a spring 284 pressing at one end against the catch 276 and at the other end against a fixed portion of the top 18. Upward extension 286 permits the catch 276 to be withdrawn to remove the stapler when desired. The catch 276 is retained in the top 18 by means of an overlying portion 338 of the upper surface of the top 18. The magazine portion 288 of the stapler 40 is pivoted at 292 to the base. The cover 296 which drives the driver blade (not shown) for the staples is pivoted at 294 to the magazine. Pivoted at 298 to the cover is a link 302 having pivoted thereto at 304 the operating lever 306 which is also pivoted at 308 to the base 268. A pneumatically operated cylinder 290 has an outwardly extending piston rod 312 the end of which bears against operating lever 306. Upon actuation of the cylinder 290 the piston rod 312 will extend upward as viewed in FIG. 5 causing counterclockwise pivoting of the operating lever 306 about pivot 308 and similarly causing counterclockwise pivoting of the magazine 288 about pivot 292 and also pivoting cover 296 counterclockwise about pivot 294 thus driving a staple by means of the driver secured inside the cover 296.

OPERATION OF THE DEVICE

Reference is now had to FIG. 6 in which is shown in simplified form the pneumatic circuit for operation of this device. As shown an electric motor operates an air compressor 310 in known manner. The outlet of the compressor tank 320 is connected by line 324 to a regulator 318 which insures that a specific air pressure of relatively narrow tolerances is maintained within the circuit. For example, the motor driven air compressor 310 may be set to turn on at 90 p.s.i. pressure in the tank 320 and to shut off at 120 p.s.i. pressure in the tank 320 or some similar values. The regulator 318, however, controls the flow therethrough so that the pressure at its outlet and in the subsequent lines is in the range of 70–75 p.s.i. Line 326 connects the regulator to a solenoid 322. The solenoid 322 comprises a safety device so that if the power to the compressor 310 is cut then this solenoid shuts off the air to the entire system thus insuring that when the power comes back on there will not be any inadvertent firing of either of the staple guns. The outlet air line from solenoid 322 is indicated at 328 and extends to valve 300 operated by pedal 330. The pedal 330 is also shown in FIG. 1. As shown in FIG. 6 the valve 300 is in Mode A in which any air in line 328 may not go beyond valve 300.

Also connected to line 328 are lines 124 and 126 (see also FIG. 3). Line 126 is the main air pressure line to the large staple gun 50 and enters the same as shown in FIG. 3 through the bottom thereof thus pressurizing hollow handle 128 as well as various channels within the gun 50. Included in the chambers pressurized in the chamber on one side of the poppet valve having the lesser area exposed to air pressure as discussed above. Line 124 leads to valve 130 and in the Mode A position shown in FIG. 6 the valve 130 permits air to pass therethrough from the line 124 to the stapler 50 and the opposite side of the poppet valve (the side with the larger area exposed to air pressure). With valve 130 and valve 300 in the mode A positions shown in FIG. 6 the poppet valve is being held in the first position for said valve as mentioned above. Valve 280 is the toggle valve and the same has been moved by the opening of the sliding top section 16 so that the large staple gun 50 is potentially actuatable but not the smaller staple 40. The trough is open and ready for use.

A stack of sheets is then placed in the trough and pedal actuated valve 300 is actuated by pressing pedal 330. Thereupon valve 300 moves to the condition or mode B shown at the top thereof in which line 328 is connected through valve 300 to line 258, through valve 280 and some distance through line 328 to a flow control valve 314. Flow control valve 314 regulates the speed with which the air pressure increases in the line 84 leading to the stack compressor 60. It is desirable that the operating stroke of the stack compressor 60 be much slower relative to the retraction stroke. The flow control valve 314 insures this. From the flow control valve 314 air is supplied through line 332 to the quick exhaust 316 which insures that the full capability of the lines are utilized to exhaust the stack compressor 60 after its operation. Under the control of the flow control valve 314 air pressure builds up in line 84 and in the cylinder of the stack compressor 60 to move the piston 334 and the anvil 70 toward the trigger mechanism 80 and the staple gun 50. The degree of compression to which the stack of sheets 100 is subjected is determined by the amount of pressure required to overcome spring 108

(see FIG. 3) plus the internal spring 338 of the micro-valve 90. When this degree of compression has been achieved the pressure of the stack of sheets against the trigger unit 80, and in particular the bumpers 112 under the pressure exerted by the anvil 70 will be such as to move the trigger unit 80 toward the right thus moving the micro-switch 90 from mode A to mode B. When micro-switch 90 has been moved to mode B air under pressure in line 116 will then pass through the valve 90 and the line 118 to the actuator portion 342 of valve 130. The acuator portion 342 may be piston-cylinder arrangement, a diaphragm arrangement or the like which responds to the pressure in line 118 by moving the portion 334 of valve 130 from mode A to mode B. When the valve 130 is in mode B pressure from the lines 328, 124 is cut off and the air in line 336 is bled through valve 130. Since the line 336 is connected to one side of the poppet valve, air is bled from that side of the valve and the poppet valve is allowed to move to its second position under the pressure exerted thereon from the other side which is connected internally of the gun 50 to the air reservoir in the handle to the line 126 which is under pressure. This movement of the poppet valve permits air in the line 126 to pressurize a cylinder thus moving a piston to which is attached the staple driver blade as aforesaid. The driving of the staple driver drives a staple through the stack of sheets and against the anvil 70 where the ends of the staples are turned over and crimped by the curved depressions 76 therein. It must be understood that once the trigger mechanism 80 has been moved upon compression of the stack of sheets 100 the valve 90 moves to its mode B quickly followed by movement of the valve 130 to its mode B also quickly followed by movement of the poppet and driving of the staple. Indeed, the operator will detect substantially no lag at all between depression of the peddle 330 and driving of the staple.

When the operator then lifts his foot from the pedal 330 the valve 300 will be returned to its mode A shown in FIG. 6 which will cause the prompt exhaust of the air pressure in the line 258 and line 256 which pressure exits to the atmosphere through valve 300, now in its mode A. This together with the quick exhaust 316 promptly causes the retraction of the piston 334 in the stack compressor 60. When the pressure of the stack compressor 60 is removed from the stack of sheets, under normal conditions, the spring 108 will be sufficient to return the trigger member to its mode A position. If the volume 100 of stacked sheets is very thick, however, say, substantially thick enough to fill the trough 20, then in that event it may be necessary to lift the volume 100 in order to permit the spring 108 to return the toggle 80 to its normal position, however, normally this is not the case and the spring is sufficient to move both the toggle 80 and the volume 100 in the trough 20 to return micro-valve 90 to its mode A position shown in FIG. 6. When returned to its mode A position as shown, the micro-valve 90 permits the exhaust of air therethrough from one side of the actuator portion 342 of valve 130 which is then returned by an internal spring to its mode A shown in FIG. 6. As previously mentioned, when in mode A the valve 130 permits pressurization from line 124 to pressurize line 336 and thus the poppet valve is returned to its original position. The system is now ready to drive yet another staple with the staple gun 50 either in another portion of the volume 100 of stacked sheets or in a subsequent volume of stacked sheets.

If one desires to use the stapler 40 rather than the staple gun 50 in order to staple thinner volumes up to say about ¼" then, in that event, the sliding section 16 of the door of the cabinet 10 is slid to close trough 20. This action (see FIG. 3) causes stop 264 to engage head 268 of toggle 254 which controls toggle valve 280. Movement of the top section 16 causes the stop 264 to pivot the toggle 254 toward the right (as viewed in FIG. 3). This causes mode B (see FIG. 6) of valve 280 to be moved into position to connect line 258 with line 262. Line 262 is connected to cylinder 290 which operates stapler 40. If an operator now steps upon the pedal 330 he again moves the mode B of the valve 300 in alignment with the pressurized line 328 whereby it may pressurize line 258. Since valve 280 is now in mode B the line 258 is permitted to pressurize line 252 causing piston cylinder 290 to move its piston rod 312 upwardly thus operating stapler 40. When the operator then removes his foot from the pedal 330 the valve 300 is returned to its mode A position shown in FIG. 6 thus permitting exhaust of air from the cylinder 290 through the line 262, through valve 280 (in its mode B position), through line 258, through valve 300 (in its mode A position) and thence to the atmosphere. This exhaust of the air allows the return of the piston rod 312 to its lower position preparatory to another stapling sequence.

RELOADING THE STAPLERS

Stapler 40 may be reloaded in a conventional manner by rotating knob 328 a quarter of a turn and retracting the same to the right. The knob 328 carries a telescoping rod 344 on the end of which carries a staple follower (not shown). A pair of springs (not shown) operate to urge the follower forwardly to push staples into position all in known manner. By rotating the knob 328 a quarter of a turn the knob 328 and the attached telescoping rod 344 together with its follower and springs may be removed from the magazine 288. Staples may then be inserted into the rear of the machine and the follower, telescoping rod 344 and knob 328 returned to their place.

Figure 8:
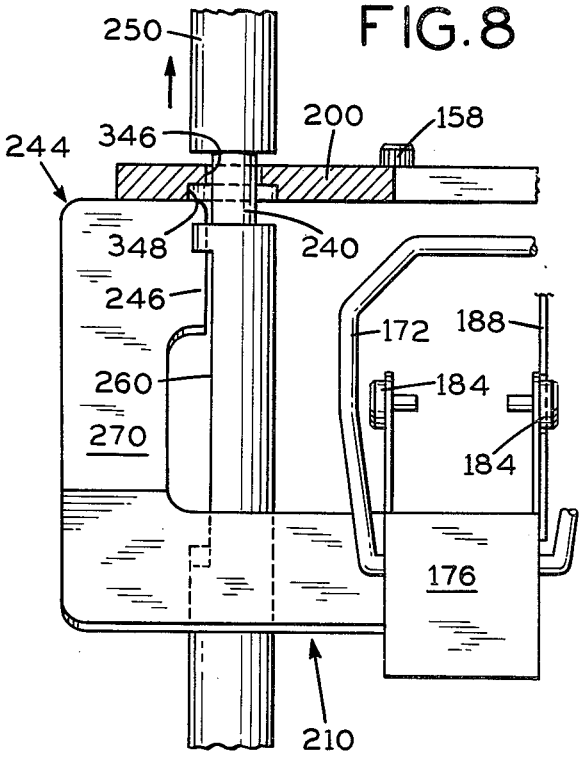
FIG. 8 is a view taken in the same direction as FIG. 4 showing the latch and safety mechanism during the initial part of the reloading operation with some parts removed for clarity.

Since the stapling gun 50 is positioned beneath the table in the position shown in the drawings it has been provided with means for loading the same from the top. Having reference now to FIGS. 3 and 4 it will be seen that the safety catch and latch mechanism 210 cannot be satisfactorily operated when the upper pusher rod 250 is in its stored horizontal position as shown in FIG. 4. The extension 188 and the finger operated terminal portion 192 thereof will not pass by the rod 250 (see also FIG. 3). Accordingly, if one wishes to clear a jam in the staple gun 50 or to add staples thereto he must first open the door 30 in the top 18 of the table. The upper pusher rod 250 is then pivoted 90° counterclockwise (as viewed in FIG. 4) about the pivot 234 until it extends upright in alighment with the lower pusher rod segment 230. Even at this point the safety catch and latch mechanism 210 cannot be successfully operated by pressing upon the terminus 192 of the lever 188 since the angular relationship of the parts is such that pivoting of the safety catch and latch mechanism 210 about the pins 184 causes the lip 246 on the safety catch 270 to move toward the lower pusher rod 230 (toward the viewer in FIG. 4). Since at this point the lower pusher rod 230 has its full diameter the lip 246 effectively prevents operation of the latch 210 by the manually operated pad 192. Accordingly the operator must push downwardly upon the rod 250 until the relieved area 260 therein aligns with the laterally extending lip 246 of the safety catch 270. While he could now operate the latch 210 to release the same thus permitting the lip 246 to pass into the relieved area 260, the normal practice is for the operator to pull or push the rod so that the reduced diameter 240 may be tightly engaged in the slot 346 (see FIG. 7) which communicates with opening 224 to form a keyhole in guide plate 200. The downwardly movement of the aligned pusher rods 230,250 causes the "C" shaped support bracket 212 to slide downwardly along rod 220. This movement of the member 212 downwardly causes it to engage the laterally extending flange 346 of the staple follower 180 thus carrying the staple follower 180 downwardly with it. When the rod 250 has been moved downwardly a sufficient distance so that the reduced diameter portion 240 aligns with the keyhole 224,346 then the rod 250 may be moved to engage the narrower slot portion 346 about the reduced portion 240. It will be appreciated that this downward movement is resisted by the flat follower spring 148 and thus it is extended to close to its fullest extent when the reduced portion 240 is in alignment with the keyhole 224,346. This relationship of the parts, before movement of the rod 250 into the narrow section 346 of the keyhole is shown in FIG. 8. If the rod 250 is then moved into the narrow portion of the slot 346 and released then, in that event, the spring 148 urges the rod 250 upwardly into the position shown in FIG. 9 in which the bottom portion of the reduced diameter 240 is fitted in a countersunk area 348 at one end of the slot 346. Thus the countersunk portion 348 tends to hold the rod 250 in the narrower portion of the keyhole 224,346 and prevent its further upward movement under the urging of the spring 148.

The rod 250 is permitted to move the short distance to and from its location in the opening 224 of the keyhole and the slot portion 346 of the keyhole in part due to the fact that the lower pusher rod 230 is secured to support 212 by only a single screw 218. However, largely, this movement is permitted by the length and flexibility of the rods 230,250.

Figure 9:
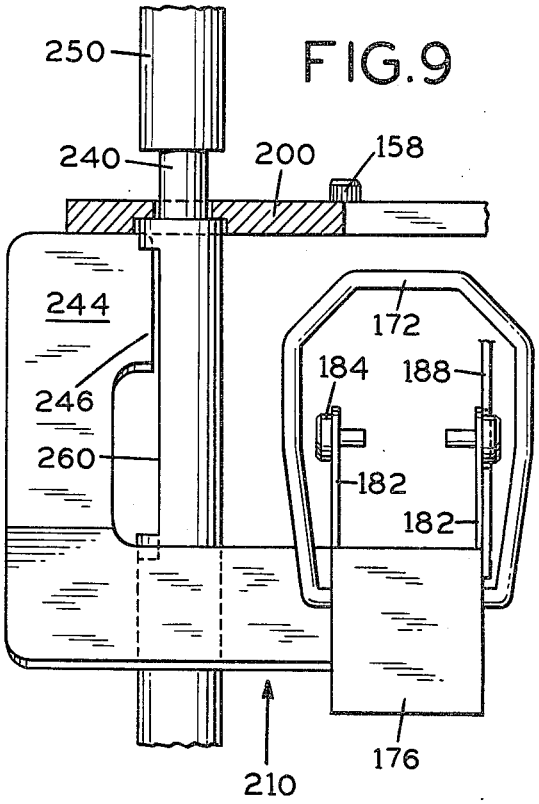
FIG. 9 is a view like FIG. 8 showing the upper pusher rod seated for reloading.

As will be seen from FIG. 9 the lip 246 on the safety catch 270 is now aligned with the relieved portion 260. As such, operation of the manually operated pad 192 by pushing the same away from the viewer in FIG. 4 i.e., to the right in FIG. 3 will permit the lip 246 to move into the relieved area thus allowing the upright portion 244 of the L-shaped safety catch 270 to move downwardly and toward the viewer (due to the location of the pivot pins 184). Continued movement of the arm 188 under pressure applied to the terminus 192 causes the members to assume the position shown in FIG. 10. In this position the lip 246 on the member 270 now bears against the bottom of the relieved portion 260 and the bail 172 has relieved its clamping pressure against the access plate 190 so that the same may be removed from its covering position with respect to the raceway 144. Pivoting of the access plate 190 about the bail 172 and pivoting of the bail 172 in the slots 174 permits the access plate 190 to be sufficiently removed from its covering relationship to the raceway 144 (see FIG. 7) as to allow for clearing of any jammed condition therein or the insertion of staples into the magazine through the slot 146 that extends through the bottom wall 148 of the raceway 144.

Figure 10:
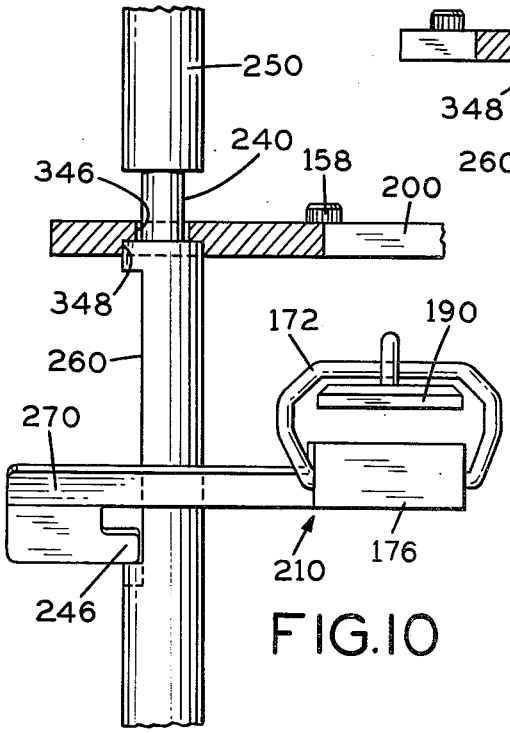
FIG. 10 is a view like FIG. 9 showing the latch and safety mechanism unlatched to provide access to the mechanism entryway.

In this relationship and position of the parts as shown in FIGS. 10 and 11, the bottom portion of the reduced diameter 240 is pressed within the countersink 348. Thus the possibility that the spring 148 could force the rods 230,250 and the follower 180 upwardly with a resultant ejection of staples upwardly from the opening 146 is effectively prevented. However, since an operator is likely to be facing the opening 146 when reloading with staples and since the danger from an inadvertent dislodgement of the reduced portion 240 from its seat in the narrow portion 346 of the keyhole could result in injury, additional safety catch means is provided. This safety catch arrangement comprises the fact that the lip 246 of the L-shaped safety catch 270 still resides within the relieved portion 260 of the rod 250 as shown in FIG. 10. In the event that the operator for any reasons should dislodge the rod 250 so that it again aligned with the hole 224 in the keyhole 224,346 the spring 148 would promptly urge the follower 180, supporting bracket 212, and pusher rods 230,250 upwardly thus threatening ejection of staples upwardly toward the operator. However, as shown in FIGS. 12 and 13 the rod 250 can move upwardly only a very short distance since the lip 246 of the safety catch 270 will be forced upward by the bottom of relieved portion 260 until as shown in FIGS. 12 and 13 the distal end 252 of the safety catch 270 comes into contact with the guide plate 200. At this point the safety catch 270 cannot move upwardly any further and the lip 246 engaged in the bottom of the relieved portion 260 prevents further upward movement of the rod 250 as well. Accordingly, the rod 250 as well as the follower 180 can move only a very short distance determined by the distance between the bottom of the reduced diameter segment 240 and the bottom of the recess 260. This distance is not sufficient to provide any momentum of significance to any staples that may be in the magazine. As such, the safety catch 270 provides a second and final very effective preventative against accidental ejection of staples upwardly toward the operator during reloading.

When reloading the staples through the opening 146 has been completed, the operator then grips the tab 192 and moves the same to the left as shown in FIG. 3 or toward the viewer (as shown in FIG. 4). As he does so he guides the access plate 190 into position over the raceway 144 with the lip 164 of the access plate engaged beneath the guide plate 200 in the recess 162. Further movement of the lever 188 by pressure upon the finger pad 192 causes the bail 172 to stretch as it passes over center and to finally come to rest again in the position shown in FIG. 3 in which the access plate 190 is firmly secured in place against the wear plate 160 thus completing all sides of the raceway 144.

During this movement to latch the access plate 190 in place, the safety catch 170 moves from the position shown in FIGS. 10 and 11 back to the position shown in FIG. 9. In this position the full length of tab 246 is out of the vertical plane of the pusher rod 250 i.e., behind the pusher rod 250 as viewed in FIGS. 4 and 9. It is now possible to move the pusher rod 250 from its position in which its reduced portion 240 is in the slot segment 346 of the keyhold 224,346 and into the hole portion 224 as shown in FIG. 12. In this position the spring 148 can now move the rod 250 freely upwardly through the opening 224. The extent of this movement is determined by the quantity of staples in the magazine 140. If the magazine has just been filled the distance will be very short whereas if the access plate 190 has been opened merely to relieve a jammed condition and no staples have been added the distance which the spring 148 will move the follower 180, support 212 and rods 230,250 will be relatively greater. In either event the spring 148 will move the rods 230,250 upwardly only until the follower 180 has engaged the staples and pushed the same upwardly to the point where the first (topmost) staple is in the guideway 144 and bearing against the inner (under) side of the access plate 190. At this point the follower 180 can move upwardly no more and movement of the rods 230,250 also ceases. The operator must then lift on rod 250 until the lower portion 230 of the rod achieves the position shown in FIG. 4. At this point the upper rod 250 is again pivoted to the horizontal portion shown in FIG. 4 and the door 30 is closed.

I claim:

1. A binding system comprising a cabinet, a top on said cabinet, a first power operated stapler mounted on said top, a trough in said cabinet, a second power operated stapler mounted below said top to one side of said trough for driving staples into a stack of sheets positioned with an edge in said trough, said top including a sliding section slidable to open and to cover the top of said trough, power means for operating said staplers, and interlock means operated by said slidable segment of said top for rendering said first power stapler inoperative and said second power stapler operative when said top section has been slid to open the trough and for rendering said first power stapler operative and said second power stapler inoperative when said sliding section has been moved to cover said trough.

2. A binding system for a stack of sheets comprising a cabinet, a top on said cabinet, a trough in said cabinet opening upwardly through the top thereof, said trough having a bottom, said top having a sliding section slidable to open and to cover said trough, power operated compressor means below said top positioned to one side of said trough, said compressor means having a portion thereof movable into and out of said trough transversely thereof for compressing a stack of sheets in said trough, a power operated stapler mounted in said cabinet below said top on the opposite side of said trough in facing relationship to said compressor means, said stapler having a raceway for guiding staples being ejected, said raceway being positioned in a plane parallel to the bottom of said trough and spaced thereabove, means for operating said compressor means to compress a stack of sheets positioned with one edge thereof on the bottom of said trough, means for operating said stapler to drive a staple along said raceway and into said stack of sheets while said stack is compressed by said compressor means, and means interconnected to said sliding section to render said stapler operative and inoperative upon sliding said section to its open and closed positions.

3. A binding system for a stack of sheets comprising a cabinet, a top on said cabinet, a trough opening upwardly through said top, a power operated stapler in said cabinet positioned below said top and to one side of said trough, a raceway in said stapler positioned in a plane parallel to and below said top, the upper wall of said raceway being defined by an access cover, said means mounting said access cover for movement into and out of covering relationship with said raceway, said stapler including a staple magazine extending downwardly from said raceway and communicating therewith, and a door in said top of said cabinet overlying said access cover for providing access to the access cover and to the raceway for loading staples into said stapler magazine therethrough the exposed raceway.

4. The device of claim 3 in which said stapler includes a staple follower, a spring for urging said staple follower upwardly to move staples along said magazine and into said raceway, means for moving said follower in a direction away from said raceway, said means for moving said follower being accessible through the door in said top, and means for latching said follower against the urging of said spring for preventing upward movement of said follower under the urging of said spring.

5. The device of claim 4 including safety catch means in addition to said latch means for insuring against upward movement of said follower under urging of said spring.

* * * * *

UNITED STATES PATENT AND TRADEMARK OFFICE

CERTIFICATE OF CORRECTION

PATENT NO. : 4,157,778

DATED : June 12, 1979

INVENTOR(S) : George F. Villwock & Conrad R. Medina

It is certified that error appears in the above-identified patent and that said Letters Patent are hereby corrected as shown below:

Column 1, line 9, "reguire" should read --require--

Column 2, line 41, "prefrably" should read --preferably--

Column 2, line 55, "seciton" should read --section--

Column 3, line 9, "stale" should read --staple--

Column 3, line 17, "drepressions" should read --depressions--

Column 3, line 18, "fact therof" should read --face thereof--

Column 5, line 4, "wall 148 coiled of the raceway" should read --wall 148 of the raceway--

Column 5, line 30, "memeber" should read --member--

Column 7, line 27, "through" should read --trough--

Column 9, line 11, "acuator" should read --actuator--

Column 9, line 14, "334" should read --344--

Signed and Sealed this

*Eleventh* Day of *December 1979*

[SEAL]

*Attest:*

SIDNEY A. DIAMOND

*Attesting Officer*

*Commissioner of Patents and Trademarks*